US006655240B1

(12) United States Patent
DeVecchis et al.

(10) Patent No.: US 6,655,240 B1
(45) Date of Patent: Dec. 2, 2003

(54) INSULATING DRIVER WITH INJECTION MOLDED SHANK AND FLUTED WORKING TIP

(75) Inventors: Marco E. DeVecchis, Racine, WI (US); Daniel M. Eggert, Kenosha, WI (US)

(73) Assignee: Snap-on Tools Company, Kenosha, WI (US)

( * ) Notice: Subject to any disclaimer, the term of this patent is extended or adjusted under 35 U.S.C. 154(b) by 637 days.

(21) Appl. No.: 09/333,166

(22) Filed: Jun. 14, 1999

Related U.S. Application Data

(63) Continuation-in-part of application No. 08/867,183, filed on Jun. 2, 1997, now abandoned.

(51) Int. Cl.[7] ..... B25B 23/00

(52) U.S. Cl. ..... 81/438; 81/900; 81/177.1

(58) Field of Search ..... 81/900, 436, 489, 81/438, 439, 177.1, 177.2, 177.85; 76/114, 119, DIG. 7

(56) References Cited

U.S. PATENT DOCUMENTS

| | | | |
|---|---|---|---|
| 1,049,650 | A | 1/1913 | Benjamin |
| 1,946,239 | A | 2/1934 | Ryan |
| 2,609,851 | A | 9/1952 | Hadfield |
| 2,620,001 | A | 12/1952 | Fratz et al. |
| 2,804,894 | A | 9/1957 | Rosenburg |
| 2,899,996 | A | 8/1959 | Stockman |
| 2,917,954 | A | 12/1959 | Capelle |
| 3,007,504 | A | 11/1961 | Clark |
| 3,173,462 | A | 3/1965 | Koeppel |
| 3,312,260 | A | 4/1967 | MacNiell |
| 3,343,577 | A | 9/1967 | Wagner |
| 3,347,293 | A | 10/1967 | Clark |
| 3,392,767 | A | 7/1968 | Stillwagon, Jr. |
| 3,884,282 | A | 5/1975 | Dobrosielski |
| 3,955,451 | A | 5/1976 | Lohness |
| 4,096,896 | A | 6/1978 | Engel |
| 4,290,465 | A | 9/1981 | Fee et al. |
| 4,739,536 | A | 4/1988 | Bandera et al. |
| 4,838,264 | A | 6/1989 | Bremer et al. |
| 5,042,333 | A | 8/1991 | Huang |
| 5,105,648 | A | 4/1992 | Steiner et al. |
| 5,259,277 | A | 11/1993 | Zurbuchen |
| 5,309,798 | A | 5/1994 | Markwart et al. |
| 5,351,586 | A | 10/1994 | Habermehl et al. |
| 5,358,026 | A | 10/1994 | Simpson |
| 5,359,911 | A | 11/1994 | Kruesi |
| 5,390,572 | A | 2/1995 | Gakhar et al. |
| 5,638,727 | A | 6/1997 | Gringer |
| 5,868,048 | A | 2/1999 | Cassutti et al. |

FOREIGN PATENT DOCUMENTS

| | | |
|---|---|---|
| EP | 565919 A1 | 10/1993 |
| GB | 1251419 | 10/1971 |

*Primary Examiner*—D. S. Meislin
(74) *Attorney, Agent, or Firm*—Seyfarth Shaw LLP

(57) ABSTRACT

An insulating hand tool has an elongated shank injection molded of a high-strength, electrically insulating material, such as glass-reinforced nylon, and a handle formed of an electrically insulating material. The handle and the shank may be molded together in a unitary, one-piece construction, or the handle end of the shank may be press-fitted in an axial bore in one end of the handle or the shank may be insert molded into the handle. The working end of the shank is adapted to carry a working tip or a socket, either of which may be insert molded in the working end of the shank or may be press-fitted in an axial bore therein. The socket may form a nut driver or define a receptacle to removably receive a working tip. The working tip may be a commercially-available, double-ended bit, with a Phillips tip at one end embedded in the shank.

14 Claims, 4 Drawing Sheets

INSULATING DRIVER WITH INJECTION MOLDED SHANK AND FLUTED WORKING TIP

CROSS-REFERENCE TO RELATED APPLICATION

This is a continuation-in-part of U.S. Ser. No. 08/867,183, tiled Jun. 2, 1997 now abandoned and entitled "Insulating Driver with Injection Molded Shank."

BACKGROUND OF THE INVENTION

1. Field of the Invention

The present invention relates to hand tools of the type which are relatively non-conducting electrically, so that they can safely be used in applications where they may come into contact with sources of electrical power.

2. Description of the Prior Art

Various types of electrically insulating hand tools have been available for many years. Such tools typically have a standard metal shaft/blade which, in addition to being connected to a handle which is formed of electrically insulating material, such as wood or plastic, is also coated or covered with an insulating material. Such insulated tools work acceptably well as long as the insulating covering is intact and in good condition. But, if the insulation becomes damaged, such a tool may be dangerous if it comes into contact with a source of electrical power, the danger being the risk of electrical shock to the user or inadvertent shorting of electrical circuits with which the shank may come in contact. Therefore, such insulated tools are not recommended for use on live electrical wiring, contacts or the like.

Certain types of tools with elongated shanks of plastic material have been provided heretofore, but they have not been hand tools provided with a handle at one end.

U.S. Pat. No. 5,259,277, discloses an electrically insulating hand tool, with a shank formed of composite material and fixedly secured, as by a suitable adhesive, in an axial bore in one end of an associated handle, which is also formed of an electrically insulating material. This screwdriver works well in terms of electrical insulation, but the adhesive attachment of the shank to the handle has disadvantages, in terms of assembly steps and torque strength of the resultant product. Furthermore, the composite material of the tool shank, while affording excellent electrical insulation characteristics, must be produced through preform resin impregnation, which has certain disadvantages as compared to other types of molding.

SUMMARY OF THE INVENTION

It is a general object of the invention to provide an electrically insulating hand tool which avoids the disadvantages of prior hand tools, while affording additional structural and operating advantages.

An important feature of the invention is the provision of an electrically insulating hand tool which is of simple and economical construction, avoiding the use of adhesives.

Another feature of the invention is the provision of an electrically insulating hand tool of the type set forth, which provides improved torque strength.

Yet another feature of the invention is the provision of a hand tool of the type set forth, which can be formed by injection molding, while offering improved electrical insulation characteristics.

These and other features of the invention are attained by providing an insulating hand tool comprising: an insulating hand tool comprising: an elongated torque-transmitting shank formed of high-strength, injection-molded, electrically insulating material and having a handle end and a working end, a handle formed of electrically insulating material and carried by the handle end of the shank, and a working tip having a mounting portion fixed in the working end of the shank and a work-engaging portion projecting from the working end of the shank, the mounting portion including an anchor portion having angularly spaced flutes substantially filled with material of the shank.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 1:
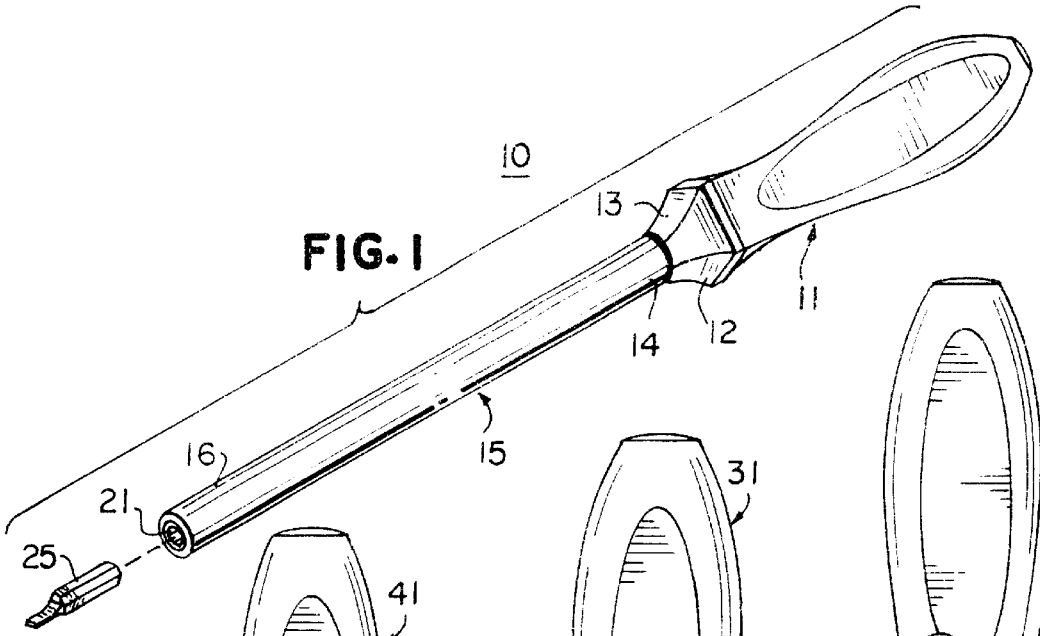
FIG. 1 is a perspective view of a hand tool in accordance with a first embodiment of the present invention, having an insert-molded socket for removably receiving a working tip.
Figure 2:
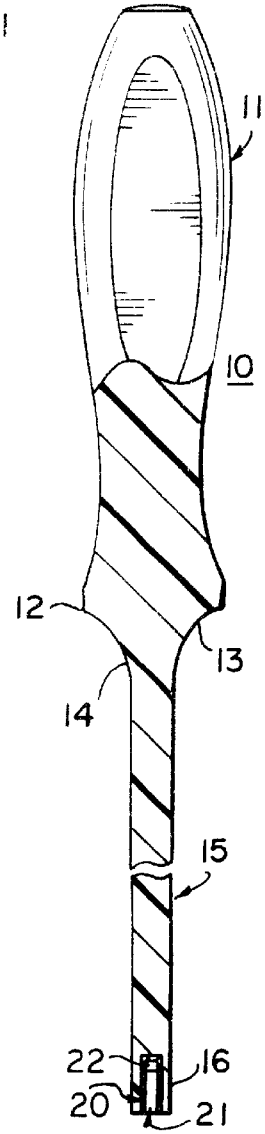
FIG. 2 is a side elevational view of the hand tool of FIG. 1, in partial section and with a portion of the shank broken away.

Referring to FIGS. 1 and 2, there is illustrated a hand tool in the nature of a screwdriver, generally designated by the numeral 10, constructed in accordance with the present invention. The screwdriver 10 is of unitary, one-piece construction, and includes an elongated handle 11 having a forward end 12 with sloping shoulders 13 which join the handle end 14 of an elongated cylindrical shank 15. While the shank 15 is illustrated as being circularly cylindrical, it will be appreciated that it could be tapered from the handle end 14 to a reduced-diameter working end 16. A generally cylindrical tip holder or socket 20 is embedded in the working end 16 of the shank 15 coaxially therewith, the tip holder 20 defining an axial receptacle 21 therein which opens at the distal end of the shank 15. A permanent magnet 22 may be seated in the receptacle 21 for removably retaining therein an associated working tip 25, which may be in the nature of a tool bit, such as a flat blade screwdriver bit. Preferably, the receptacle 21 is non-circular in transverse cross section and is shaped for mateably receiving a similarly shaped bit shank to inhibit relative rotation of the parts. A hexagonal shape is commonly used. Also, it will be appreciated that the outer surface of the tip holder 20 may be non-circular in transverse cross section to inhibit rotation of the tip holder 20 relative to the shank 15.

It is a significant aspect of the present invention that the screwdriver 10 is injection molded of a high-strength electrically insulating material. Suitable materials which have the requisite strength and electrical insulation properties, as well as being injection-moldable, include nylon, PVC, glass-reinforced nylon and glass-reinforced PVC. In a preferred constructional model of the invention, the screwdriver 10 is formed of glass-reinforced nylon material, which has been found to provide improved insulating properties. In particular, the glass-reinforced nylon material meets the IEC900 standard for insulating hand tools of 1,000 volts. The tip holder 20 may be formed of a suitable metal, and the magnet 22 may be a neodymium magnet. The tip 25 is formed of any suitable magnetizable metal material.

Figure 3:
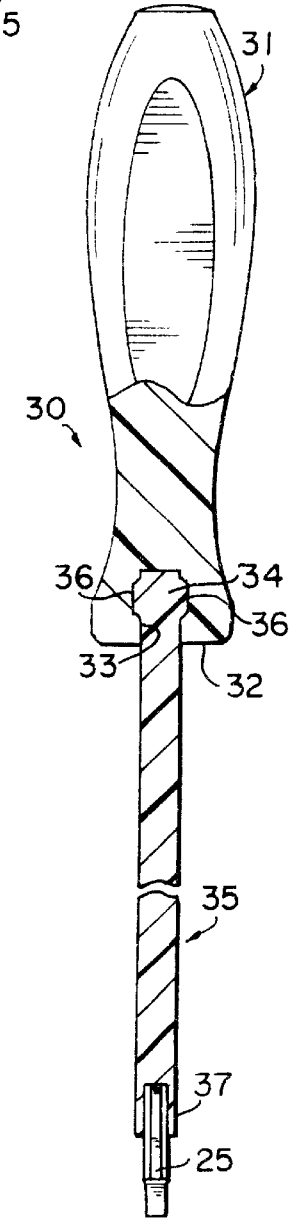
FIG. 3 is a view similar to FIG. 2 of a second embodiment of the present invention.

Referring to FIG. 3, there is illustrated another screwdriver 30 which is not of unitary, one-piece construction. The screwdriver 30 has an elongated handle 31 which is similar to the handle 11, described above, and terminates in a flat, generally circular forward end 32. An axial bore 33 is formed in the forward end 32 and receives therein the handle end 34 of an elongated shank 35. The shank 35 may be provided with a pair of diametrically opposed wings 36 extending laterally outwardly therefrom, the handle end 34 being adapted to be press-fitted in the bore 33, with the wings 36 embedding in the handle material for inhibiting rotation of the shank 35 relative to the handle 31. The shank 35 has a working end 37 which has a tip, such as the tip 25, insert molded directly therein coaxially therewith.

The shank 35 is substantially the same as the shank 15 described above, except that it is not unitary with the handle. More specifically, the shank 35 is injection molded of a suitable material, preferably glass-reinforced nylon, with the tip being insert molded in the shank 25 during the molding process. The handle 31 is independently formed of a suitable electrically insulating material, which may be the same as or different from the material of the shank 35. While the shank 35 is shown with a working tip 25 insert molded directly therein, it will be appreciated that the working end 37 of the shank 35 could have insert molded therein a tip holder or socket 20, as in the screwdriver 10, for removably receiving an associated tip.

Figure 4:
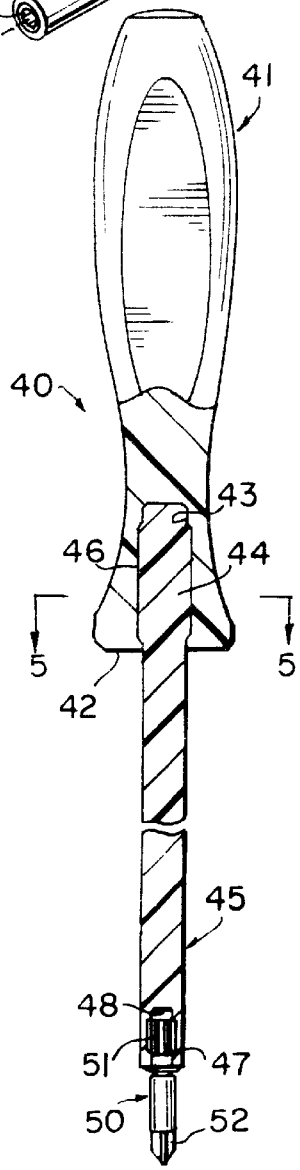
FIG. 4 is a view similar to FIG. 2 of yet another embodiment of the present invention.
Figure 5:
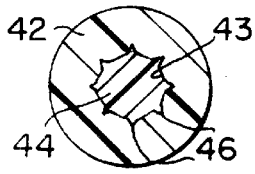
FIG. 5 is an enlarged sectional view taken generally along the line 5—5 in FIG. 4.

Referring to FIGS. 4 and 5, there is illustrated a screwdriver 40, which is similar to the screwdriver 30, except that the handle 41 has an axial bore 43 in the forward end 42 thereof which has an axial extent somewhat greater than that of the bore 33. The screwdriver 40 has a shank 45 which is similar to the shank 35, having an elongated handle end 44 adapted to be press-fitted in the bore 43 of the handle 41. Preferably, the handle end 44 has equiangularly spaced apart therearound a plurality of radially outwardly extending ribs or splines 46, which dig into the material of the handle 41 and inhibit rotation of the shank 45 relative to the handle 41. The shank 45 has a working end 47 with an axial receptacle 48 formed therein, which may be circularly cylindrical in shape and is adapted for am receiving an associated working tip 50. More particularly, the tip 50 may be provided with knurling 51 to afford a press-fitted engagement in the receptacle 48, which will inhibit relative rotational movement of the parts. The tip 50 is illustrated as having a screw starting end 52, but it will be appreciated that other types of working tips or bits could be utilized. Preferably, the shank 45 is formed by the same process and of the same material as the shank 35, described above.

While each of the screwdrivers 10, 30 and 40 has been illustrated with a particular type of bit or tip-mounting arrangement, it will be appreciated that any one of these screwdrivers could be provided with either a bit-receiving socket insert molded in the shank, a bit directly insert molded in the shank or a bit press-fitted in an axial bore in the shank. Also, it will be appreciated that the shanks 35 and 45 could be insert molded in the handles 31 and 41, respectively.

Figure 6:
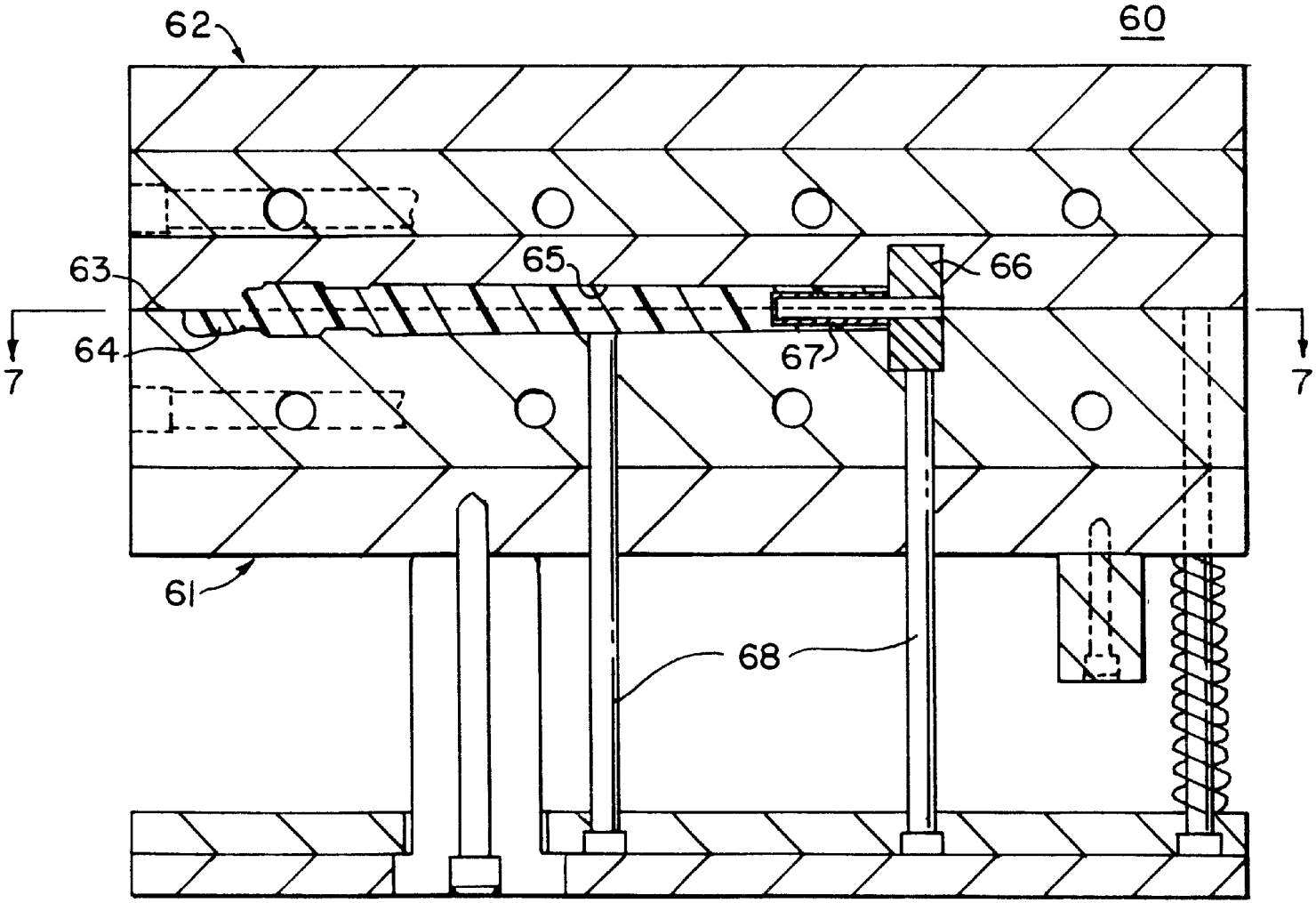
FIG. 6 is a vertical sectional view through an injection mold for forming the screwdriver of the present invention.
Figures 7, 8, 9, 10, 11:
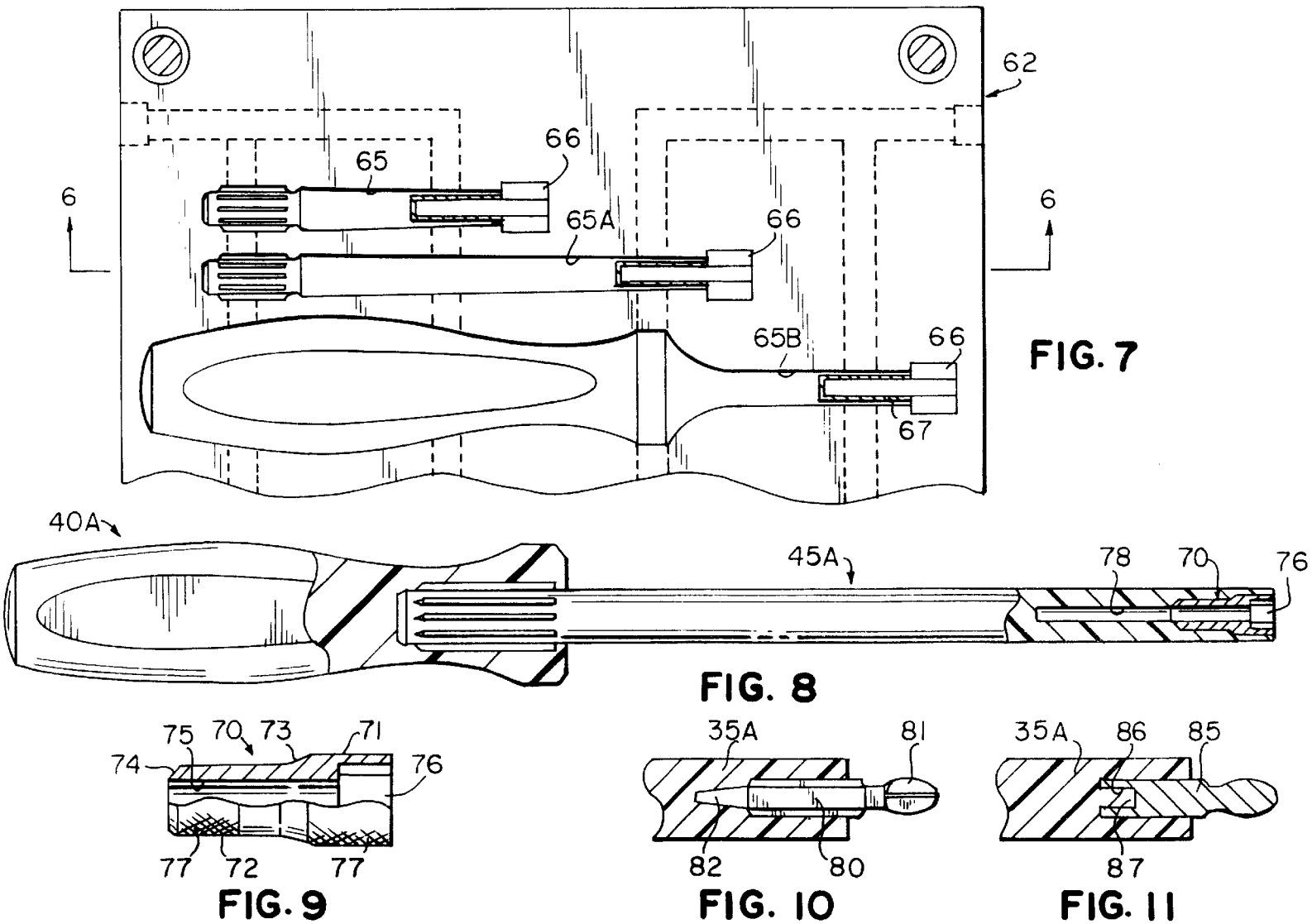
FIG. 7 is a bottom plan view of the top half of the mold of FIG. 6, indicating at 6—6 the plane at which the view of FIG. 6 is taken.
FIG. 8 is a view similar to FIG. 5, in partial section, of another embodiment of the invention.
FIG. 9 is an enlarged sectional view of the socket insert molded in the shank of FIG. 8.
FIG. 10 is an enlarged, fragmentary, sectional view of another embodiment of the invention.
FIG. 11 is a view similar to FIG. 10 of still another embodiment of the invention.
Figure 12:
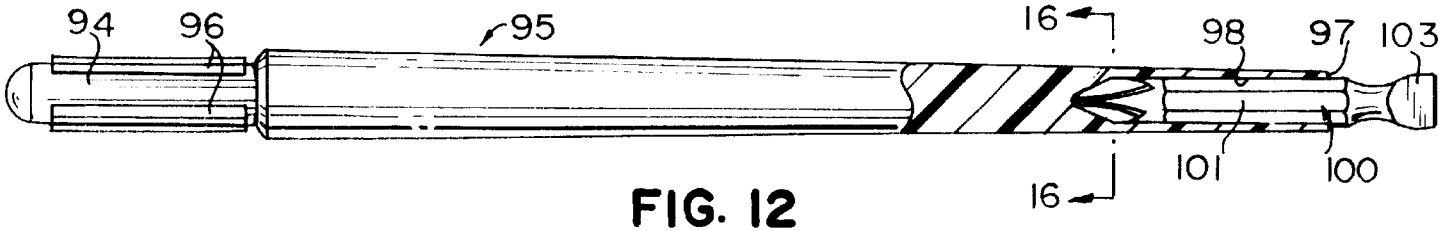
FIG. 12 is a side elevational view, in partial section of a shank and working tip in accordance with another embodiment of the invention.
Figure 14:
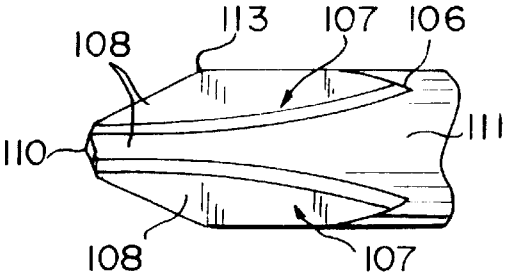
FIG. 14 is a further enlarged, fragmentary side elevational view of the left-hand end of the working tip of FIG. 13.

Referring now to FIGS. 6 and 7, there is illustrated an injection mold 60 of the type which may be used for forming the screwdriver 10 or the shanks 35 and 45 of the screwdrivers 30 and 40. The injection mold 60 includes a lower half 61 and an upper half 62 which, in use, are joined together at a parting plane 63. Formed in the mold 60 are cavities 65, 65A and 65B, each of which is formed partly in the lower half 61 and partly in the upper half 62, so that, when the halves are joined, as illustrated in FIG. 6, the cavities 65 will be longitudinally bisected by the parting plane 63. In the illustrated embodiment, the mold 60 has three cavities, the cavities 65 and 65A being of the type for forming the shank 35 or 45, and the cavity 65B being of the type for forming a unitary, one-piece screwdriver 10, the shanks being shown slightly tapered in this case. It will be appreciated that any number of cavities could be provided, and that the cavities 65–65B are shown only for purposes of illustration. Preferably, there is mounted in the mold 60 adjacent to the distal ends of the cavities 65–65B, insert holders 66 which are adapted to retain inserts 67 in predetermined positions coaxially in the associated cavities 65–65B. It will be appreciated that the insert 67 may be in the form of a tip holder or socket 20, a tip or bit 25, or a pin designed to be removed after molding to form a receptacle 48.

In operation, after the insert holders 66 are mounted in position for holding the inserts 67 in the appropriate location, the mold 60 is closed and the plastic material is injected in liquid form through an injection gate 64, preferably at one end of the cavities 65–65B. The plastic material, preferably glass-reinforced nylon, is injected under suitable pressure until it completely fills the cavities 65–65B, flowing around the inserts 67. The flow of plastic material then ceases, the mold is allowed to cool for a predetermined period of time and the mold is then opened to remove the molded parts with the aid of ejector pins 68, all in a known manner.

Referring now to FIGS. 8 and 9, there is illustrated another embodiment of the invention in the form of a nut driver 40A, which is substantially the same as the screwdriver 40 of FIG. 4, except for the working end of the shank, which is designated 45A. A socket member 70 is disposed in the working end of the shank 45A, preferably by insert molding. The socket member 70 is an elongated, generally tubular member, having an enlarged-diameter end 71 and a reduced-diameter end 72, joined by a sloping shoulder 73. A chamfer 74 may be formed on the reduced-diameter end 72. The socket member 70 has an axial bore 75 extending therethrough and is provided in the large-diameter end 71 with an enlarged hexagonal receptacle 76 which communicates with the bore 75 and is shaped for driving an associated nut or similar fastener. Preferably, the outer surface of the ends 71 and 72 are knurled, as at 77, to inhibit rotation within the shank 45A.

The socket member 70 is disposed in the shank 45A with the end face of the large-diameter end 71 substantially flush with the distal end of the working end of the shank 45A, as illustrated in FIG. 8. Preferably, an axial bore 78 is formed in the shank 45A rearwardly of the socket member 70 and communicating with the bore 75 to provide clearance for associated screws, bolts, studs or the like with which a driven nut may be associated. While, in the illustrated embodiment, the socket member 70 is insert molded in the shank 45A, as by use of an injection mold like that shown in FIGS. 6 and 7, it will be appreciated that it could be press fitted in a bore or receptacle in the working end of the shank 45A.

It is significant that the tapered geometry of the socket member 70 provides for increased thickness of shank material in the region 79 surrounding the reduced-diameter end 72 of the socket member 70. It has been found that this configuration serves to limit bending fractures to the region of the large-diameter end 71, wherein the fractures are limited to the insert member itself and are retained by the surrounding shank material so as to prevent projectiles from occurring. Absent the reduced-diameter end 72, bending fractures would tend to occur in the plastic material of the shank at the inner end of the socket member, which could result in relatively large and dangerous projectiles.

Referring also to FIG. 10, there is another embodiment of the invention in which a working tip 80 is insert molded in the distal end of a shank 35A, which may be essentially the same as the shank 35 shown in FIG. 3. In this case, the working tip 80 has an exposed blade end 81 and a reduced cross-section inner end 82, which preferably has a non-circular shape. This arrangement, with the resulting increased thickness of shank material surrounding the reduced cross-section end 82 has been found to provide improved resistance to relative rotation between the working tip 80 and the shank 35A.

FIG. 11 discloses another alternative embodiment, in which a working tip 85 is insert molded in the end of the shank 35A. In this case the working tip 85 has an axial bore 86 formed in the inner end thereof which fills with plastic material as at 87, during the injection molding operation. Again, this configuration has been found to provide improved resistance to relative rotation of the parts.

While in the embodiments of FIGS. 10 and 11, the insert molded member is illustrated as being a working tip, it will be appreciated that the same principles could be applied to insert-molded tip holders. Also, while insert molding of the parts is disclosed in FIGS. 10 and 11, similar principles could be applied to parts which are press-fitted in bores in the end of the shank, in which case the bore could be formed to have a geometry similar to that of the part to be press-fitted therein.

Referring now to FIGS. 12–16, there is illustrated another embodiment of the invention, which includes an elongated shank 95, which may be substantially the same as either the shank 35 of FIG. 3 or the shank 45 of FIG. 4. The shank 95 has a reduced-diameter handle end 94 having equiangularly spaced apart therearound a plurality of radially outwardly extending ribs or splines 96. The handle end 94 is adapted to be coupled to a handle, such as the handle 31 or 41, in the manner described above, with the ribs or splines 46 digging in the material of the handle to inhibit rotation of the shank 95 relative to the handle. It will also be appreciated that, if desired, the shank 95 could be formed unitary with the handle in a one-piece molded construction, in the manner described above in connection with the screwdriver 10 of FIG. 2.

The shank 95 has a working end 97 adapted to receive a working tip 100 fixedly therein. Preferably, the working tip 100 is insert molded in the working end 97 of the shank 95, in the manner described above in connection with FIG. 3, but it will be appreciated that, alternatively, the working end 97 could have an axial receptacle 98 formed therein in which the working tip 100 is press fitted, similar to the embodiment of FIG. 4, described above. While the shank 95 is described as having a slight taper from the handle end to the working end, it will be appreciated that it could have an untapered cylindrical shape.

The working tip 100 has an elongated polygonal shank 101, preferably hexagonal in transverse cross section, provided at one end with a work-engaging portion 102 including a work-engaging blade 103, coupled to the shank 101 by a reduced neck 104. Integral with the shank 101 at the other end is an anchor portion 105, joined to the shank 101 as by a reduced neck 106, and defining a plurality of equiangularly spaced flutes or recesses 107 alternating with blades 108. In the illustrated embodiment, the work-engaging blade 103 is a flat blade for engaging a slot head screw, but it will be appreciated that it could have other shapes for engaging other types of fasteners or the like.

In the preferred embodiment, the anchor portion 105 is in the form of a fluted screwdriver tip of the type sold under the trademark PHILLIPS. It has been found that a no. 2 size of PHILLIPS-type fluted tip works well, but it will be appreciated that other tip sizes could also be used. The no. 2 size has four flutes resulting in a generally cruciform transverse cross section, with each blade 108 having a minimum thickness at the distal end 110 and a maximum thickness at a forward end 111. Each blade 108 is also tapered in radial extent from a minimum at the distal end 110 to a maximum at a point 113. Each flute 107 has a maximum depth in a transverse plane through the points 113, the depth reducing therefrom, both forwardly and rearwardly. There results a transverse cross-sectional area of the anchor portion 105 which has a minimum value at the distal end 110 and a maximum value at the forward (right-hand, as viewed in FIGS. 12–14) ends of the flutes 107.

Figure 16:
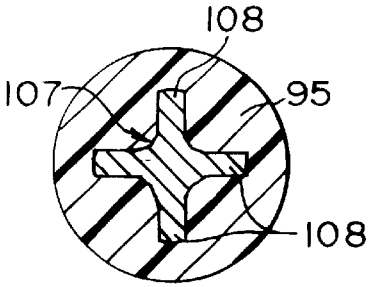
FIG. 16 is an enlarged cross-sectional view taken generally along the line 16—16 in FIG. 12.
Figure 13:
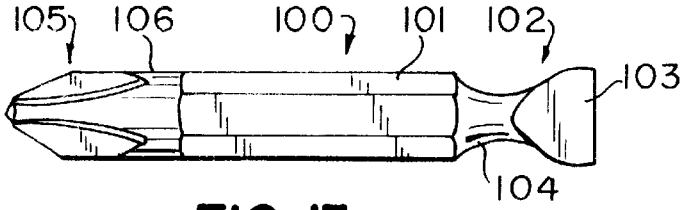
FIG. 13 is an enlarged, side elevational view of the working tip of FIG. 12.
Figure 15:
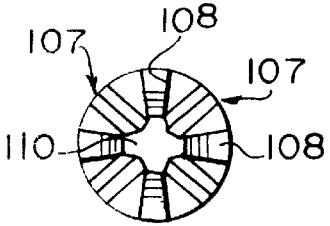
FIG. 15 is an end elevational view of the left-hand end of the working tip of FIG. 14.

In use, the anchor portion 105 and most of the polygonal shank 101 cooperate to form a mounting portion which is embedded in the working end 97 of the shank 95, so that the flutes 107 are substantially filled with the material of the shank 95, as can best be seen in FIG. 16. This provides a firm interlock between the working tip 100 and the shank 95, affording greatly increased torsional strength of the joint to resist relative rotation of the working tip 100 and the shank 95. It has also been found that this tip geometry significantly reduces failures in the plastic material of the shank.

While, in the preferred embodiment, the working tip is in the form of a double-ended, commercially available bit, for reasons of economy, it will be appreciated that custom-design configurations could also be utilized. More specifically, while a PHILLIPS-type fluted anchor portion configuration is preferred, other types of fluted or recessed configurations could be utilized, as long as the flutes have a fairly substantial depth.

From the foregoing, it can be seen that there has been provided an improved electrically insulating hand tool and method of making same, wherein the tool can be fabricated without the use of adhesives in a simple and economical process which incorporates injection molding, the tool shanks being formed of a high-strength injection-moldable material, which affords improved electrical insulation characteristics.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. An insulating hand tool comprising:

an elongated torque-transmitting shank formed of high-strength, injection-molded, electrically insulating material and having a handle end and a working end, a handle formed of electrically insulating material and carried by the handle end of the shank, and a working tip having a mounting portion fixed in the working end of the shank and a work-engaging portion projecting from the working end of the shank, the mounting portion including an anchor portion having a radius and angularly spaced flutes each having a maximum radial depth which is a substantial portion of the radius, the flutes being substantially filled with material of the shank.

2. The hand tool of claim 1, wherein the shank has a longitudinal axis and the flutes are substantially equiangularly spaced about the axis.

3. The hand tool of claim 1, wherein the flutes are more than two in number.

4. The hand tool of claim 3, wherein the flutes are four in number.

5. The hand tool of claim 1, wherein the anchor portion has a transverse cross-sectional area which is tapered from a minimum area at a distal end of the mounting portion to a maximum area at a location spaced axially from the distal end.

6. The hand tool of claim 1, wherein the mounting portion includes a portion of substantially polygonal transverse cross section disposed between the anchor portion and the work-engaging portion.

7. The hand tool of claim 1, wherein the shank is formed of glass-reinforced nylon.

8. The hand tool of claim 1, wherein the shank and the handle cooperate to form a unitary one-piece construction.

9. The hand tool of claim 1, wherein the handle has an axial bore formed in one end thereof, the handle end of the shank being press-fitted in the bore.

10. The hand tool of claim 1, wherein the shank is insert molded in the handle.

11. The hand tool of claim 1, wherein the working tip is insert molded in the shank.

12. A method of forming an insulating hand tool comprising:

injection molding an elongated, torque-transmitting shank from a high-strength, electrically insulating material, joining a first end of the molded shank to a handle formed of electrically insulating material, and fixing in a second end of the molded shank a working tip having a mounting portion having a radius and with angularly spaced flutes each having a maximum radial depth which is a substantial portion of the radius, the flutes being embedded in the shank such that the flutes are substantially filled with material of the shank.

13. The method of claim 12, wherein the working tip is insert molded in the second end of the shank.

14. An insulating hand tool comprising:

an elongated torque-transmitting shank formed of high-strength, injection-molded, electrically insulating material and having a handle end and a working end, a handle formed of electrically insulating material and carried by the handle end of the shank, and a working tip having a mounting portion fixed in the working end of the shank and a work-engaging portion projecting from the working end of the shank, the mounting portion including an anchor portion having a radius tapering from a maximum radius to a minimum radius and angularly spaced flutes each having a maximum radial depth which is a substantial portion of the maximum radius, the flutes being substantially filled with material of the shank.

* * * * *